US009604270B2

(12) United States Patent
Noe

(10) Patent No.: US 9,604,270 B2
(45) Date of Patent: Mar. 28, 2017

(54) METHOD AND APPARATUS FOR STRETCH-LEVELING METAL STRIP

(71) Applicant: Andreas Noe, Kerken (DE)

(72) Inventor: Andreas Noe, Kerken (DE)

(73) Assignee: BWG BERGWERK—UND WALZWERK—MASCHINENBAU GMBH, Duisburg (DE)

( * ) Notice: Subject to any disclaimer, the term of this patent is extended or adjusted under 35 U.S.C. 154(b) by 161 days.

(21) Appl. No.: 14/298,517

(22) Filed: Jun. 6, 2014

(65) Prior Publication Data

US 2015/0013417 A1 Jan. 15, 2015

(30) Foreign Application Priority Data

Jun. 14, 2013 (DE) ..... 10 2013 106 243

(51) Int. Cl.

| | |
|---|---|
| ***B21D 1/05*** | (2006.01) |
| *B21B 37/48* | (2006.01) |
| *B21B 37/28* | (2006.01) |
| *B21B 15/00* | (2006.01) |

(52) U.S. Cl.

CPC ..... *B21D 1/05* (2013.01); *B21B 37/28* (2013.01); *B21B 37/48* (2013.01); *B21B 2015/0071* (2013.01)

(58) Field of Classification Search

CPC .... B21D 1/00; B21D 1/02; B21D 1/05; B21B 1/22; B21B 1/222; B21B 1/24; B21B 1/38; B21B 2015/0028; B21B 2015/0071; B21B 37/16; B21B 37/28; B21B 37/48; B21B 37/50; B21B 37/52; B21B 37/56; B21B 37/70; B21B 38/02; B21B 38/04; B21B 38/06; B21B 2263/04; B21B 2263/06; B21B 2263/08; B21B 2265/02; B21B 2265/04; B21B 2265/06; B21B 2265/08; B21B 2265/14; B21B 2265/16; B21B 2265/18

USPC ..... 72/6.2, 7.1, 7.2, 7.4, 11.1, 12.3, 12.4, 72/28.2, 29.1, 31.02, 31.03, 31.07, 31.08, 72/31.09, 160–165, 205, 224, 234, 235, 72/365.2, 366.2, 379.2, 377, 378

See application file for complete search history.

(56) References Cited

U.S. PATENT DOCUMENTS

| | | | | |
|---|---|---|---|---|
| 5,666,836 A | | 9/1997 | Bonnefont | |
| 5,722,279 A | * | 3/1998 | Ogawa | B21B 37/68 72/11.4 |
| 5,855,132 A | * | 1/1999 | Cozzi | B21D 1/05 72/160 |
| 2009/0282883 A1 | * | 11/2009 | Noe | B21D 1/05 72/160 |

(Continued)

*Primary Examiner* — Peter DungBa Vo
*Assistant Examiner* — Joshua D Anderson
(74) *Attorney, Agent, or Firm* — Andrew Wilford

(57) ABSTRACT

A metal strip is gripped by an upstream set of infeed tension rollers and, downstream therefrom in a strip-travel direction, by a downstream set of outfeed tension rollers. These tension rollers are rotated so as to tension the strip between the upstream and downstream sets and move the strip downstream in the strip-travel direction. Between the sets the strip first passes around individually supported relatively rotatable stretch rollers to increase a plastic stretch ratio of the strip, and then through a plurality of straightening rollers to reduce curvature and residual tension of the strip and also to increase the plastic stretch ratio of the strip.

18 Claims, 2 Drawing Sheets

(56) References Cited

U.S. PATENT DOCUMENTS

| | | | | |
|---|---|---|---|---|
| 2012/0174643 | A1* | 7/2012 | Noe | B21D 1/05 72/164 |
| 2013/0111962 | A1* | 5/2013 | Noe | B21D 41/026 72/164 |

* cited by examiner

METHOD AND APPARATUS FOR STRETCH-LEVELING METAL STRIP

FIELD OF THE INVENTION

The present invention relates to a method of and apparatus for stretch-leveling metal strip. More particularly this invention concerns such a method and apparatus for stretch-leveling high-strength steel strip.

BACKGROUND OF THE INVENTION

In a typical stretch-leveling process for metal strip, the strip passes through a set of infeed tension rollers for applying tension and a set of outfeed tension rollers for relieving the tension. In a first process step, the strip is alternatingly bent between the set of infeed tension rollers and the set of outfeed tension rollers around individually supported (that is to say, not frictionally interconnected) stretch rollers so as to be increasingly stretched. Then in a downstream step, relative to a strip-travel direction, the strip passes through a multiroller straightening set downstream of the last stretch roller and having a plurality of straightening rollers around which the strip is bidirectionally bent for reducing strip curvature and/or residual tension. The extent to which the strip (overall) is plastically stretched and therefore elongated is called the stretch ratio.

With a stretch-leveling method such as this, nonplanar metal strip can be leveled and thus, nonplanarities can be eliminated. Nonplanarity means, for example, strip waviness and/or strip camber that come about as a result of differences in length of the strip fibers in the strip plane. However, nonplanarity also means strip curvatures longitudinally and/or transversely that come about as a result of bending moments in the strip, for example, when the strip was bent elastic-plastically around deflection rollers, and/or due to deformations during winding of the strip. Longitudinal curvature is also referred to as coil set, transverse curvature is also referred to as cross bows. In the process of stretch-leveling, the nonplanar strip is bent (bidirectionally) while under tension that lies below the elastic limit of $R_E$, that is, the technical elastic limit $R_{P\,0.01}$ thereof of the strip material, around rollers of sufficiently smaller diameters that by the combination of tension and bending, an elastic/plastic deformation is produced in the strip. The strip is plastically elongated and the level of the plastic elongation is referred to as stretch ratio. During plastic elongation, the originally short strip fibers are elongated to a relatively stronger degree. Ideally, all strip fibers are of the same length after being leveled so that basically a perfectly leveled strip free of waviness or strip cambers is produced.

With the prior-art stretch-leveling method, residual bending moments can remain in the strip after leveling due to the bidirectional bending in the elastic-plastic region that can become visual as transverse curvature in the strip treatment line, and in a cut-out plate can lead to a longitudinal and/or transverse plastic residual curvature. The residual bending moments come about when the individual bends are not coordinated with one another in their intensity. The bending radii depend on the strip data (thickness, elasticity module, cyclic strength behavior, Poisson's ratio), the strip tensile stress, the diameter of the roller, and the geometry of the strip path around the rollers. In a first approximation, the latter can be described by the wrap angle of the strip around the rollers. With a sufficiently large wrap angle or sufficient tensile stress, the strip assumes the radius of the roller. The strip curvature then reaches its maximum and remains constant with increasing wrap angle or increasing tensile stress. However, as a rule, the wrap angles are adjusted such that the strip does not follow the roller radius.

Even with an optimal adjustment of a predetermined stretch-leveling stand, residual bending moments occur due to fluctuations of the process parameters. For in practice, both the tensile stress, and consequently the stretch ratio as well as the mechanical strength properties and the strip thickness of the strip are basically subject to certain fluctuations.

The simple stretch-leveling process with only three bends reacts relatively sensitively to fluctuations in the mentioned parameters. Therefore, depending on application, unacceptably high residual curvatures remain in the strip.

A distinct improvement is brought about by a stretch-leveling process with four individual straightening rollers that can be set up individually (see US 2012/0174643).

There are higher requirements, for example, if the stretch limit and the required stretch ratio become very high, for example, with high-strength steel strip. More bends may then be required in order to keep the residual curvature values within smaller values, for example, smaller than $10^{-1}$ (1/m).

The conventional solution, with which a plurality of bends can be used is a multiroller straightening set having, for example, a fixed lower cassette or an adjustable upper cassette with straightening rollers and backing rollers. As a rule, the upper cassette can be vertically positioned, and can be adjusted with respect to its inclination. In this manner, wrap angles decreasing linearly from roller to roller can be achieved, with the first and the last straightening roller each only having half the wrap angle and primarily functioning as pass line rollers. The disadvantage of such a conventional solution is that within a cassette the straightening rollers are frictionally coupled to one another by the backing rollers, that is to say, all the straightening rollers run at the same speed. However, due to the elongation (that is, the stretch ratio) generated in the strip during the stretch-leveling, the strip accordingly runs faster and faster from roller to roller. As a result, slippage occurs in the multiroller set with the resultant to vibrations that can lead to undesired chatter marks on the strip. The risk of chatter marks increases with the stretch ratio so that in practice, this type of design is mostly used with low stretch ratios.

For these reasons, it has already been proposed to combine conventional stretch-leveling stands with multiroller straightening units. Such a stretch-leveling method of the type as described above is known from U.S. Pat. No. 5,666,836. The roller settings are adjusted using a control that works using a mathematical model with or without feedback. The stretch ratio is thereby generated by stretch rollers that can operates as pairs. In the multiroller set, only the correction of longitudinal curvature errors then takes place without substantially increasing the stretch ratio.

The advantages of a combination of a stretch-leveling stand having a multiroller straightening unit have already been described in the technical articles "Advances in Leveling Machines" by Keiji Yamamoto and Keizo Abe in "Journal of the Research Group of Flattened Metal Technology 31 (1992), 24-31". There, the stretch ratio is also produced with stretch rollers that are set up in pairs. The correction of curvature errors then takes place in the multiroller set.

OBJECTS OF THE INVENTION

It is therefore an object of the present invention to provide an improved method of an apparatus for stretch-leveling metal strip.

Another object is the provision of such an improved method of an apparatus for stretch-leveling metal strip that overcomes the above-given disadvantages, in particular that with little system-technical expenditure ensures optimal planarity results, particularly also with high-strength strip and high required stretch ratios.

SUMMARY OF THE INVENTION

A metal strip is gripped by an upstream set of infeed tension rollers and, downstream therefrom in a strip-travel direction, by a downstream set of outfeed tension rollers. These tension rollers are rotated so as to tension the strip between the upstream and downstream sets and move the strip downstream in the strip-travel direction. Between the sets the strip first passes around individually supported relatively rotatable stretch rollers to increase a plastic stretch ratio of the strip, and then through a plurality of straightening rollers to reduce curvature and residual tension of the strip and also to increase the plastic stretch ratio of the strip.

Thus, according to the invention, the plastic stretch ratio is generated both with the stretch rollers and proportionally with the multiroller straightening set. The invention is thereby based on the discovery that the leveling results can be significantly improved if the stretch ratio is not ultimately or basically exclusively generated with the stretch rollers, but if the multiroller set is also included in a targeted manner into the generation of a considerable part of the stretch ratio. It is therefore within the scope of the invention that at least 5% of the plastic stretch ratio, preferably at least 10% of the plastic stretch ratio, is generated with the downstream multiroller straightening set.

It is thereby particularly effective if a considerable part of this stretch ratio is generated with the furthest upstream or first straightening roller or with the first two straightening rollers of the multiroller straightening set. It is then preferably if at least 5% of the plastic stretch ratio, preferably at least 10% of the plastic stretch ratio, is generated with the first straightening roller of the multiroller straightening set. The invention has thereby realized that the first roller of the multiroller straightening set in particular can be used to a considerable degree for generating the stretch ratio. The fact that a considerable elongation of the strip takes place at the first roller of the multiroller straightening set does not lead to the problem of chatter marks because the second straightening roller following the first straightening roller is not frictionally connected to the first straightening roller. Only the third roller of the multiroller straightening set is a component part of the same cassette as the first straightening roller so that a substantial stretch ratio at the first straightening roller does not lead to undesired chatter marks.

According to a further embodiment of the invention of particular importance, the wrap angle decreases from roller to roller, at least at the stretch rollers and the furthest upstream or first straightening roller, preferably however at all straightening rollers. For example, on the stretch rollers and optionally on least the first straightening roller, the wrap angle decreases from roller to roller by at least 5% (with respect to the wrap angle of the respective preceding roller). The invention has thereby realized that in the already known embodiments it is of disadvantage if stretch roller pairs are utilized in which each stretch roller of such a stretch roller pair has approximately the same wrap angle. It is actually beneficial for the balance of the residual tension, if the wrap angles and thus the strip curvatures decrease from roller to roller. It is thereby particularly beneficial if the wrap angles decrease from roller to roller to a greater extent during the first bends that generate the stretch ratio, and to a lesser extent during further bends.

An apparatus that operates according to such a method is particularly robust with respect to residual curvatures. From a mechanical point of view, this is realized in a particularly economical way because there is not a plurality of single cassettes involved, but because in the described manner, initially, individual stretch rollers and then the multiroller straightening set are provided that operate according to the invention.

It is thereby advantageous if the wrap angles at the stretch rollers and the straightening rollers initially decrease from roller to roller by higher and subsequently by lower differences. This can be realized, for example, such that the wrap angles from the first stretch roller to the first straightening roller decrease from roller to roller by a first constant difference, and from the second straightening roller to the last straightening roller decrease from roller to roller by a second, preferably smaller difference. Alternatively, it is within the scope of the invention that the wrap angles decrease from the first stretch roller to the first straightening roller by differences that become smaller from roller to roller.

The configuration of the method with decreasing wrap angles results in an insensitivity of the method with respect to residual curvatures.

The invention further recognizes that it is beneficial with respect to residual waviness, for example, if the roller spacings between the individual stretch rollers as well as between the last stretch roller and the first straightening roller do not decrease but are either approximately identical or even increase in the strip-travel direction. It is thereby particularly beneficial if the roller spacings are relatively large. Preferably, they are each at least 300 mm. It is therefore within the scope of the invention that between two succeeding stretch rollers as well as between the last stretch roller and the first straightening roller, the spacings are each at least one third, preferably at least one half of the width of the strip, or the maximal width of the strip. In any case, by sufficiently large horizontal spacings (that is, in the strip-travel direction) from roller to roller, the tendencies of central waviness in the stretch rollers can be avoided and/or minimized.

The apparatus according to the invention for stretch-leveling metal strip is provided with at least one set of infeed tension rollers for tensioning the strip and one set of outfeed tension rollers for relieving tension in the strip, as well as several individually supported stretch rollers between the set of infeed tension rollers and the set of outfeed tension rollers around which the strip is bent bidirectionally, thereby increasing the stretch ratio. Furthermore, between the infeed tension roller set and the outfeed tension roller set, there is a multiroller straightening set downstream of the last stretch roller, having a plurality of straightening rollers, and around which the strip is bent bidirectionally for reducing strip curvature and/or residual tension.

The multiroller straightening set is provided with an upper straightening cassette having upper straightening rollers and a lower straightening cassette having lower straightening rollers, and at least one of the straightening cassettes, for example the upper straightening cassette, can be moved with respect to height and inclination. The multiroller straightening set is immediately downstream of the last stretch roller, that is there are no further sets of tension rollers (braking roller set and/or tension roller set) between the last stretch roller and the multiroller straightening set.

It is further practical that at least the furthest downstream or last stretch roller can preferably be set up for control of its position. It is particularly preferable that (all) upper stretch rollers and/or (all) lower stretch rollers can be set up individually, preferably set up so that their positions can be controlled. However, the fact that the individual stretch rollers—unlike a multiroller straightening set—are not frictionally interconnected is of particular importance. The first straightening roller of the multiroller straightening set is also not frictionally connected to the preceding stretch roller, and is also not frictionally connected to the second straightening roller. As already described, as a result of this solution, chatter marks are avoided. For different strip, optimal wrap angle combinations can be flexibly set.

Optimal results can be achieved if a relatively large number of rollers are employed. The solution according to the invention with stretch rollers on the one hand and a multiroller straightening set on the other hand is characterized by an economical design and limited construction length. It is thereby of advantage if at least four stretch rollers, preferably five, are provided. If need be, even more stretch rollers can be used. The multiroller straightening set is provided with at least eight straightening rollers, preferably at least ten.

It is also effective that between the set of infeed tension rollers and the set of outfeed tension rollers upstream of the first stretch roller, an infeed deflection roller is provided so that already at the first stretch roller, the wrap angle, and thus the strip curvature, can be flexibly set.

A deflection roller such as this can at the same time be configured as a strip-tension sensor, for it is optionally effective if a strip-tension sensor is provided between the set of infeed tension rollers and the set of outfeed tension rollers.

The apparatus is further equipped with a controller that is connected to the various apparatus components. To start with, the controller can be connected to the drives of the infeed tension roller set and the outfeed tension roller set. Alternatively, or complementary thereto, the controller can be connected to the positioner of the stretch rollers and the positioner of the multiroller straightening set. Consequently, a position-precise set-up of the rollers, and thus a precise setting of the desired wrap angles can be realized by the controller.

It is thereby within the scope of the invention to determine the roller set-ups using a mathematical model that at least takes the characteristic values of the material (that is to say, e-modulus, transverse contraction ratio, elastic limit and/or hardening modulus) as well as the machine geometry, the strip thickness, the strip width, the tensile stress, and the stretch ratio into consideration. The set-ups of the rollers, and the spacings in particular, are entered into the machine geometry. However, the invention thereby provides that the set-ups are not calculated with the aid of a mathematical model within the controller, but according to the invention, predetermined values for the roller set-ups are entered into the controller. These target values for the roller set-ups can be calculated in advance with the aid of the described mathematical model, and can then be passed on to the controller as value table so that within the framework of the controls, the predetermined settings have then only to be realized.

The invention can be especially preferably realized with high-strength steel strip that can have a thickness of, for example, 0.15 mm to 2 mm, for example, 0.5 mm to 2 mm. However, the described advantages can also be realized with strip of other thicknesses, and also with strip of different material.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
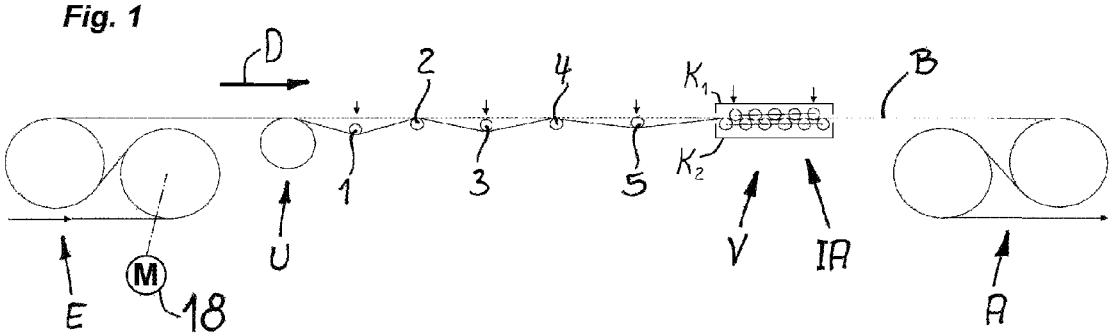
FIG. 1 is a side-schematic view of the apparatus according to the invention for stretch-leveling metal strip in a simplified side view.
Figure 1A:
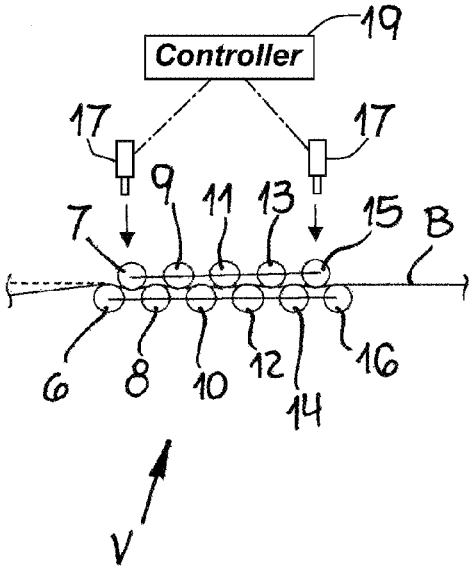
FIG. 1A is a large-scale view of the detail indicated at 1A in FIG. 1.

As seen in FIG. 1 an apparatus for stretch-leveling metal strip B is provided with a set of infeed tension rollers A for applying tension to the strip and a set of outfeed tension rollers E for relieving tension in the strip B. The tension rollers A and E displace the strip B in a normally horizontal travel direction D. Between the set of infeed tension rollers A and the set of outfeed tension rollers E, a deflection roller U and downstream therefrom, five individually supported stretch rollers 1, 2, 3, 4, 5 are arranged, around which the strip B is bidirectionally bent, thereby increasing the stretch ratio. The infeed and outfeed rollers E and A are rotated by respective drives as illustrated at 18 for rollers E, with the output rollers A rotating slightly faster than the input rollers E in order to maintain tension in the strip B and to take up the extra length imparted as described below to the strip B.

Downstream of the last stretch roller 5, a multiroller straightening set V is provided that has a plurality of straightening rollers 6 to 16 around which the strip is bidirectionally bent for reducing strip curvature and/or residual tension. The multiroller straightening set V is directly downstream of the last stretch roller 5, without further tension roller sets being between the last stretch roller 5 and the multiroller straightening set V. The multiroller straightening set V is thereby basically comprised of an upper leveling cassette K1 and a lower leveling cassette K2, the upper leveling cassette being adjustable with respect to height and inclination by one or more positioning actuators 17 operated by a controller 19. Each of the straightening rollers 6 to 16 of the multiroller straightening set V is supported by unillustrated backing rollers, that is, between rollers and backing rollers, and the individual rollers of the upper leveling cassette K1 on the one hand and the individual rollers of the lower leveling cassette K2 are frictionally interconnected by the backing rollers, that is synchronized, like a 1:1 transmission. This is not illustrated in the figures.

In the illustrated embodiment, the three upper stretch rollers 1, 3, and 5 of the individual stretch rollers 1 to 5 can be adjusted by positioning actuators 17 such as shown for the straightening roller 1 and 15. As for the others, the spaces between two stretch rollers 1-5 directly following one another as well as between the last, that is the furthest downstream, stretch roller 5 and the first straightening roller 6 increase in the strip-travel direction D.

With the illustrated apparatus, metal strip, and in particular high-strength metal strip, can be stretch-leveled according to a method of the type described above. To this end, the apparatus is operated such that the plastic stretch ratio is not exclusively generated with the stretch rollers 1 to 5, but proportionally also by the upper rollers 1, 9, 11, 13, and 15 and the lower rollers 6, 8, 10, 12, 14, and 16 of the multiroller straightening set V, and particularly by the first, that is the furthest upstream, straightening roller 6.

Figure 2:
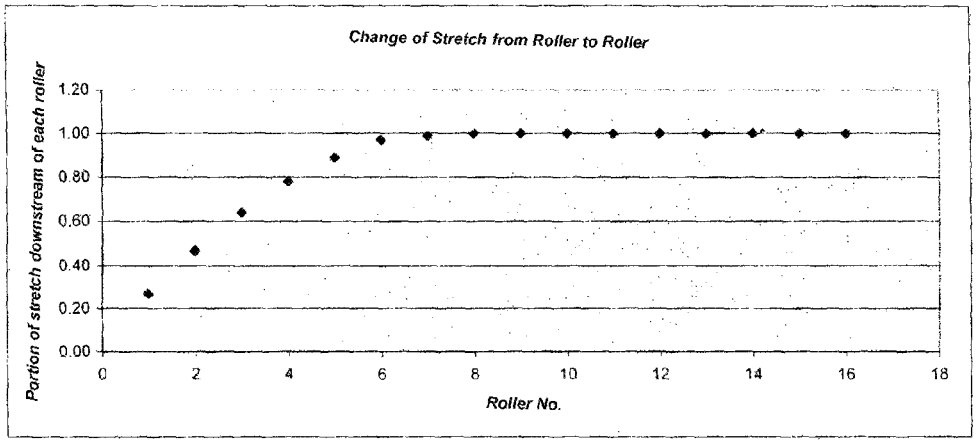
FIG. 2 is a graph of the development of the (relative) stretch ratio from roller to roller in an apparatus according to FIG. 1, and FIG. 3*a*, 3*b* show examples of two different settings for the wrap angles at the rollers.

This can be seen in FIG. 2. There, the (relative) stretch ratios of each of the rollers 1-16 are graphically illustrated. The stretch ratio develops from roller to roller in the following manner, where the respective proportion of the total stretch ratio after each roller 1-16 is indicated.

| Roller No. | Proportion of the stretch ratio after each roller |
|---|---|
| 1 | 0.27 |
| 2 | 0.47 |
| 3 | 0.64 |
| 4 | 0.78 |
| 5 | 0.89 |
| 6 | 0.97 |
| 7 | 0.99 |
| 8 | 1.00 |
| 9 | 1.00 |
| 10 | 1.00 |
| 11 | 1.00 |
| 12 | 1.00 |
| 13 | 1.00 |
| 14 | 1.00 |
| 15 | 1.00 |
| 16 | 1.00 |

A proportion of the stretch ratio after roller 1 of 0.27 consequently corresponds to a stretch ratio of 27% of the total stretch ratio after this roller 1. In this illustrated embodiment, after roller 8, a proportion of the stretch ratio of 1.0, and consequently, the total stretch ratio is reached. The same holds true for the data in FIG. 2. There, the respective proportion of the total stretch ratio after each of the rollers is indicated.

It becomes clear from the table, that is, from FIG. 2, that particularly with the first straightening roller 6 of the multiroller straightening set V, a substantial portion of the stretch ratio of more than 10% is still being generated. This is possible because the first straightening roller 6 is neither frictionally connected to the preceding stretch roller 5, nor to the subsequent straightening roller 7.

Figure 3A:
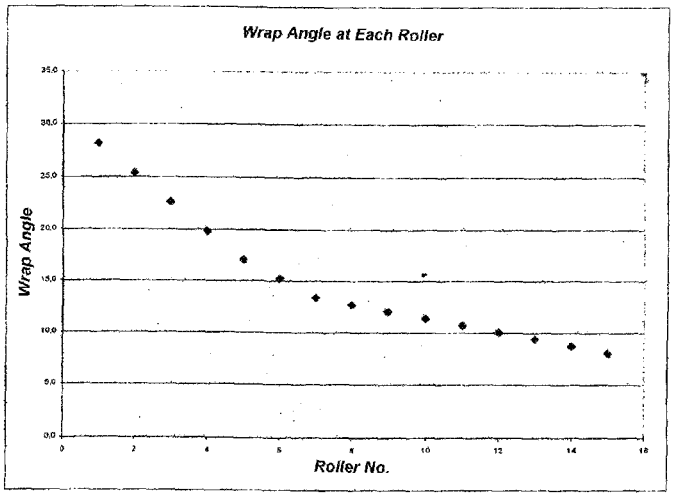

It is also important according to the invention that by the individual position setting, the wrap angle can be flexibly adjusted. According to the invention, a "slow" decrease of the wrap angle occurs. To this end, there are various possibilities. FIG. 3*a* shows a first variation, where the wrap angles decrease from roller to roller from the first stretch roller 1 to the first straightening roller 6 by a first constant difference so that the dots to rollers 1 to 6 are basically connected by a straight line with a first gradient. Thereafter, the wrap angles decrease from the second straightening roller 7 to the last or furthest downstream straightening roller 16 by a second constant difference that is lower than the first difference. In this way, the dots to the rollers 7 to 16 can basically be connected by a second straight line with a second gradient that in terms of amount is less.

Figure 3B:
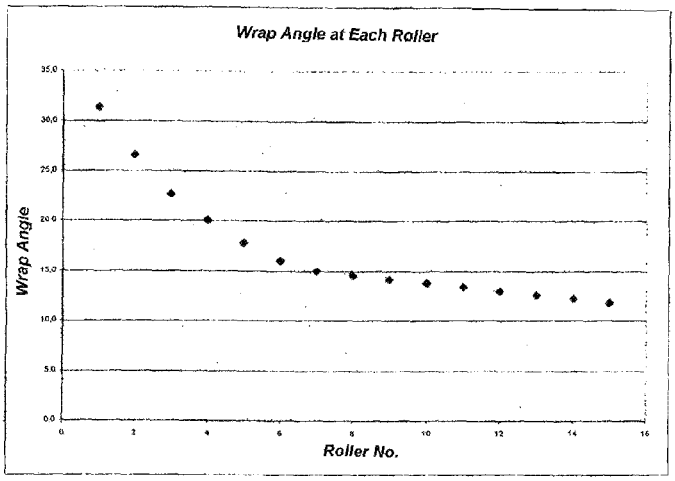

FIG. 3*b* shows a modified mode of operation where the wrap angles from the first stretch roller 1 to the first straightening roller 6 decrease by smaller and smaller differences. From the second straightening roller 7 to the last straightening roller 16, once again basically constant differences are set.

Either way, such modes of operation are characterized by an evenly degrading bending effect, because the wrap angles decrease "fluidly," so to speak, from roller to roller.

I claim:

1. A method of stretch-leveling metal strip, the method comprising the steps of:

gripping the strip with an upstream set of infeed tension rollers and, downstream therefrom in a strip-travel direction, with a downstream set of outfeed tension rollers;

rotating the upstream and downstream tension rollers so as to tension the strip between the upstream and downstream sets and move the strip downstream in the strip-travel direction;

passing the strip between the sets around individually supported relatively rotatable stretch rollers spaced in the travel direction to plastically stretch the strip;

engaging the strip downstream of the stretch rollers and upstream of the downstream set with a plurality of straightening rollers spaced in the travel direction to reduce curvature and residual tension of the strip and also to plastically stretch the strip; and relatively orienting the straightening rollers and a furthest upstream roller of the stretch rollers such that the strip engages the straightening rollers in a region extending angularly over a wrap angle that decreases downstream from roller to roller and such that at the stretch rollers the wrap angle of the strip decreases in the travel direction by a greater amount than in the plurality of straightening rollers.

2. The stretch-leveling method defined in claim 1, wherein at least 5% of the plastic stretch is generated with the straightening rollers and at least 5% of the plastic stretch is generated with a furthest upstream roller of the straightening rollers.

3. The stretch-leveling method defined in claim 1, wherein, at least starting at a furthest upstream straightening roller, the wrap angle of the strip decreases from roller to roller by at least 5%.

4. The stretch-leveling method defined in claim 1, wherein from a furthest upstream stretch roller to the first straightening roller, the wrap angle decreases from roller to roller by a first constant difference, and from the second straightening roller to the last straightening roller it decreases from roller to roller by a second smaller difference.

5. The stretch-leveling method defined in claim 1, wherein from a furthest upstream stretch roller to a furthest upstream straightening roller, the wrap angles decrease from roller to roller by differences that become smaller going downstream.

6. An apparatus for stretch-leveling metal strip comprising:

an upstream set of rotatable infeed tension rollers gripping the strip;

downstream therefrom in a strip-travel direction, a downstream set of outfeed rotatable tension rollers also gripping the strip, the upstream and downstream tension rollers rotating so as to tension the strip between the upstream and downstream sets and move the strip downstream in the strip-travel direction;

individually supported relatively rotatable stretch rollers downstream of the upstream set, around which the strip passes, spaced in the travel direction, and operable to plastically stretch the strip; and downstream of the stretch rollers and upstream of the downstream set, a plurality of straightening rollers spaced in the travel direction and engaging the strip so as to reduce curvature and residual tension of the strip and also so as to plastically stretch the strip, the straightening rollers and a furthest upstream roller of the stretch rollers being relatively oriented such that the strip engages the rollers in a region extending angularly over a wrap angle that decreases downstream from roller to roller and such that at the stretch rollers the wrap angle of the strip decreases in the travel direction by a greater amount than in the plurality of straightening rollers.

7. The stretch-leveling apparatus defined in claim 6, wherein the downstream straightening rollers has an upper leveling cassette holding a plurality of the rollers and a lower leveling cassette holding another plurality of the straightening rollers, at least one of the leveling cassettes being adjustable with respect to height and inclination.

8. The stretch-leveling apparatus defined in claim 6, wherein a furthest downstream stretch roller can be adjusted with respect to its position.

9. The stretch-leveling apparatus defined in claim 6, wherein the stretch rollers are formed by upper and lower interleaved stretch rollers, and the stretch rollers can be adjusted individually with respect to position.

10. The stretch-leveling apparatus defined in claim 6, wherein spacings in the travel direction between two directly succeeding stretch rollers and between a furthest downstream stretch roller and a furthest upstream straightening roller are generally identical or increase in the strip-travel direction.

11. The stretch-leveling apparatus defined in claim 6, wherein a spacing between two directly succeeding stretch rollers and between the furthest downstream stretch roller and the furthest upstream straightening roller are each at least 300 mm.

12. The stretch-leveling apparatus defined in claim 6, wherein spacings between two directly succeeding stretch rollers and between the furthest downstream stretch roller and the furthest upstream straightening roller are each at least one third of the width of the strip or of a maximal width of the strip.

13. The stretch-leveling apparatus defined in claim 6, wherein there are at least four of the stretch rollers.

14. The stretch-leveling apparatus defined in claim 6, wherein there are at least eight straightening rollers.

15. The stretch-leveling apparatus defined in claim 6, further comprising:

an infeed deflection roller upstream of the first stretch roller.

16. The stretch-leveling apparatus defined in claim 6, further comprising:

between the upstream set of infeed tension rollers and the downstream set of outfeed tension rollers, a strip-tension sensor formed at least partly by at least one deflection roller.

17. The stretch-leveling apparatus defined in claim 6, further comprising:

respective drives of the set of infeed tension rollers and the set of outfeed tension rollers;

respective positioners of the stretch rollers and of the straightening rollers; and a controller connected to the drives and positioners.

18. The stretch-leveling apparatus defined in claim 17, wherein the controller stores predetermined target roller settings that are determined by calculation beforehand, and are subsequently entered into the controller.

* * * * *